US008994550B2

(12) United States Patent
Millot et al.

(10) Patent No.: US 8,994,550 B2
(45) Date of Patent: Mar. 31, 2015

(54) TRANSMITTER AND RECEIVER SYNCHRONIZATION FOR WIRELESS TELEMETRY SYSTEMS

(75) Inventors: Guillaume Millot, Montrouge (FR); Erwann Lemenager, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1074 days.

(21) Appl. No.: 13/059,071

(22) PCT Filed: Aug. 21, 2009

(86) PCT No.: PCT/EP2009/060846

§ 371 (c)(1),
(2), (4) Date: May 3, 2011

(87) PCT Pub. No.: WO2010/069623

PCT Pub. Date: Jun. 24, 2010

(65) Prior Publication Data

US 2011/0205080 A1 Aug. 25, 2011

(30) Foreign Application Priority Data

Aug. 22, 2008 (EP) ..... 08162855

(51) Int. Cl.
*G01V 3/00* (2006.01)
*E21B 47/16* (2006.01)
*E21B 47/12* (2012.01)

(52) U.S. Cl.
CPC ..... *E21B 47/16* (2013.01); *E21B 47/122* (2013.01)
USPC ..... 340/854.4; 340/854.6; 340/853.2; 340/853.1; 340/855.6; 367/83; 367/81

(58) Field of Classification Search
CPC ..... E21B 47/122; E21B 47/14; E21B 47/12; E21B 47/16; E21B 47/182
USPC ..... 340/854.4, 854.6, 853.2, 853.1, 855.6, 340/855.7; 367/83, 81
See application file for complete search history.

(56) References Cited

U.S. PATENT DOCUMENTS 5,050,132 A 9/1991 Duckworth
5,056,067 A 10/1991 Drumheller
(Continued)

FOREIGN PATENT DOCUMENTS

EP 0550521 7/1993
EP 0636763 2/1995
(Continued)

OTHER PUBLICATIONS

International search report for the equivalent PCT patent application No. PCT/EP2009/060846 issued on Mar. 1, 2010.

*Primary Examiner* — Steven Lim
*Assistant Examiner* — Hongmin Fan
(74) *Attorney, Agent, or Firm* — Cameron R. Sneddon; Diana M. Sangalli

(57) ABSTRACT

A method and system are presented for transmitting data along tubing in a borehole, comprising generating an acoustic signal using a transmitter at a first location on the tubing, and receiving the acoustic signal at a receiver at a second location on the tubing. The method and system further comprise: (i) generating the acoustic signal at the transmitter at a first frequency and bit rate; (ii) receiving the acoustic signal at the first frequency at the receiver and attempting to synchronize the receiver at the first frequency, and (iiia) if the synchronization is successful, continuing to transmit the acoustic signal so as to pass the data from the transmitter to the receiver; or (iiib) if the synchronization is unsuccessful, adjusting the frequency and/or bit rate of the signal and repeating steps (i)-(iii) on the basis of the adjusted signal.

20 Claims, 9 Drawing Sheets

(56) References Cited

U.S. PATENT DOCUMENTS

| | | | | |
|---|---|---|---|---|
| 5,124,953 | A | 6/1992 | Grosso | |
| 5,128,901 | A | 7/1992 | Drumheller | |
| 5,128,902 | A | 7/1992 | Spinnler | |
| 5,148,408 | A | 9/1992 | Matthews | |
| 5,222,049 | A | 6/1993 | Drumheller | |
| 5,274,606 | A | 12/1993 | Drumheller et al. | |
| 5,293,937 | A | 3/1994 | Schultz et al. | |
| 5,477,505 | A | 12/1995 | Drumheller | |
| 5,568,448 | A | 10/1996 | Tanigushi et al. | |
| 5,675,325 | A | 10/1997 | Taniguchi et al. | |
| 5,703,836 | A | 12/1997 | Drumheller | |
| 5,815,035 | A | 9/1998 | Yamagishi et al. | |
| 5,923,937 | A | 7/1999 | Thompson et al. | |
| 5,941,307 | A | 8/1999 | Tubel | |
| 5,995,449 | A * | 11/1999 | Green et al. | 367/83 |
| 6,137,747 | A | 10/2000 | Shah et al. | |
| 6,147,932 | A | 11/2000 | Drumheller | |
| 6,188,647 | B1 | 2/2001 | Drumheller | |
| 6,192,988 | B1 | 2/2001 | Tubel | |
| 6,272,916 | B1 | 8/2001 | Taniguchi et al. | |
| 6,320,820 | B1 | 11/2001 | Gardner et al. | |
| 6,321,838 | B1 | 11/2001 | Skinner | |
| 6,912,177 | B2 | 6/2005 | Smith | |
| 2006/0187755 | A1 | 8/2006 | Tingley | |
| 2008/0180273 | A1 * | 7/2008 | Kyle et al. | 340/855.3 |

FOREIGN PATENT DOCUMENTS

| | | |
|---|---|---|
| EP | 0773345 | 5/1997 |
| EP | 1033843 | 9/2000 |
| EP | 1076245 | 2/2001 |
| EP | 1193368 | 3/2004 |
| EP | 1882811 | 1/2008 |
| EP | 1585358 | 2/2008 |
| WO | 92/06275 | 4/1992 |
| WO | 96/24751 | 8/1996 |
| WO | 00/77345 | 12/2000 |
| WO | 01/39412 | 5/2001 |
| WO | 02/27139 | 4/2002 |
| WO | 2005/005724 | 1/2005 |
| WO | 2007/095111 | 8/2007 |

* cited by examiner

TRANSMITTER AND RECEIVER SYNCHRONIZATION FOR WIRELESS TELEMETRY SYSTEMS

CROSS-REFERENCE TO RELATED APPLICATION

The present application is based on and claims priority to European Patent Application No. EP08162855, filed Aug. 22, 2008.

TECHNICAL FIELD

The present invention relates to telemetry systems for use with installations in oil and gas wells or the like. In particular, the present invention relates to the synchronization of transmitters and receivers for transmitting data and control signals between a location down a borehole and the surface, or between downhole locations themselves.

BACKGROUND ART

One of the more difficult problems associated with any borehole is to communicate measured data between one or more locations down a borehole and the surface, or between downhole locations themselves. For example, in the oil and gas industry it is desirable to communicate data generated downhole to the surface during operations such as drilling, perforating, fracturing, and drill stem or well testing; and during production operations such as reservoir evaluation testing, pressure and temperature monitoring. Communication is also desired to transmit intelligence from the surface to downhole tools or instruments to effect, control or modify operations or parameters.

Accurate and reliable downhole communication is particularly important when complex data comprising a set of measurements or instructions is to be communicated, i.e., when more than a single measurement or a simple trigger signal has to be communicated. For the transmission of complex data it is often desirable to communicate encoded digital signals.

Downhole testing is traditionally performed in a "blind fashion": downhole tools and sensors are deployed in a well at the end of a tubing string for several days or weeks after which they are retrieved at surface. During the downhole testing operations, the sensors may record measurements that will be used for interpretation once retrieved at surface. It is only after the downhole testing tubing string is retrieved that the operators will know whether the data are sufficient and not corrupted. Similarly when operating some of the downhole testing tools from surface, such as tester valves, circulating valves, packer, samplers or perforating charges, the operators do not obtain a direct feedback from the downhole tools.

In this type of downhole testing operations, the operator can greatly benefit from having a two-way communication between surface and downhole. However, it can be difficult to provide such communication using a cable since inside the tubing string it limits the flow diameter and requires complex structures to pass the cable from the inside to the outside of the tubing. A cable inside the tubing is also an additional complexity in case of emergency disconnect for an offshore platform. Space outside the tubing is limited and a cable can easily be damaged. Therefore a wireless telemetry system is preferred.

A number of proposals have been made for wireless telemetry systems based on acoustic and/or electromagnetic communications. Examples of various aspects of such systems can be found in: U.S. Pat. No. 5,050,132; U.S. Pat. No. 5,056,067; U.S. Pat. No. 5,124,953; U.S. Pat. No. 5,128,901; U.S. Pat. No. 5,128,902; U.S. Pat. No. 5,148,408; U.S. Pat. No. 5,222,049; U.S. Pat. No. 5,274,606; U.S. Pat. No. 5,293,937; U.S. Pat. No. 5,477,505; U.S. Pat. No. 5,568,448; U.S. Pat. No. 5,675,325; U.S. Pat. No. 5,703,836; U.S. Pat. No. 5,815,035; U.S. Pat. No. 5,923,937; U.S. Pat. No. 5,941,307; U.S. Pat. No. 5,995,449; U.S. Pat. No. 6,137,747; U.S. Pat. No. 6,147,932; U.S. Pat. No. 6,188,647; U.S. Pat. No. 6,192,988; U.S. Pat. No. 6,272,916; U.S. Pat. No. 6,320,820; U.S. Pat. No. 6,321,838; U.S. Pat. No. 6,912,177; EP0550521; EP0636763; EP0773345; EP1076245; EP1193368; EP1320659; EP1882811; WO96/024751; WO92/06275; WO05/05724; WO02/27139; WO01/39412; WO00/77345; WO07/095111.

Because of the repetitive structure of piping structure used, the characteristic of the acoustic propagation along pipes is such that the frequency response of the channel is complex. FIG. 13 shows the experimental and theoretical frequency response of a piping structure comprising two pipes below the wave source and eight pipes above. The spectrum has numerous peaks and troughs which are difficult to predict beforehand. Given the spectrum and the use of a mono-carrier modulation scheme, choosing a peak for the carrier frequency of the transmitted modulated signal where noise is incoherent with the signal is advantageous in term of signal to noise ratio. Choosing a carrier frequency around a locally flat channel response, i.e. no distortion, is advantageous to maximize the bit rate. In any case, choosing the carrier frequency in situ is a requirement, and the process of choosing the right frequency may take time and computing resources and has to be as simple as possible.

US 2006/0187755 by Robert Tingley discloses a method and system for communicating data through a drill string by transmitting multiple sets of data simultaneously at different frequencies. The Tingley reference attempts to optimize the opportunity of successful receipt despite the acoustic behavior of the drill string, and thereby avoiding the problem of selecting a single frequency.

Moreover, U.S. Pat. No. 5,995,449 by Clark Robison et al. discloses a method and apparatus for communicating in a wellbore utilizing acoustic signals. However, the Robison et al. disclosure relates specifically to an apparatus and method for transmitting acoustic waves through the completion liquid as a transmission medium, rather than the tubing or pipe string.

It is an object of the present invention to provide a system that allows automatic synchronization of transmitters and receivers on an appropriate frequency for reliable data transmission along tubing in a borehole.

BRIEF DISCLOSURE OF THE INVENTION

A first aspect of the present invention provides a method of transmitting data along tubing in a borehole, comprising generating a modulated acoustic signal using a transmitter at a first location on the tubing, and receiving the acoustic signal at a receiver at a second location on the tubing; the method further comprising:

(i) generating the acoustic signal at the transmitter at a first frequency and bit rate;

(ii) receiving the acoustic signal at the first frequency at the receiver and attempting to synchronize the receiver at the first frequency; and (iiia) if the synchronization is successful, continuing to transmit the acoustic signal so as to pass the data from the transmitter to the receiver; or (iiib) if the synchronization is unsuccessful, adjusting the frequency and/or bit rate of the acoustic signal and repeating steps (i)-(iii) on the basis of the adjusted signal.

Preferably, step (iiib) comprises adjusting the frequency to one of a predetermined set of frequencies. The predetermined set of frequencies can comprise the first frequency and more than two further frequencies, the method further comprising iterating steps (i)-(iii) though the set of frequencies until synchronization is successful.

Step (iiib) may also comprise adjusting the bit rate of the signal to a lower bit rate. In one embodiment, the step of adjusting the bit rate follows adjustment of frequency.

A preferred embodiment of the present invention further comprises retransmitting the data received by the receiver from the second location to a third location. This can be as an acoustic or electromagnetic signal.

A second aspect of the present invention provides a system for transmitting data along tubing in a borehole, comprising:

a transmitter at a first location on the tubing for generating an acoustic signal in the tubing; and a receiver at a second location on the tubing for receiving the acoustic signal; wherein the transmitter is configured to transmit data at a first frequency and bit rate; and the receiver is configured to attempt to synchronize at the first frequency, such that if the synchronization is successful, the transmitter continues to transmit the signal so as to pass the data from the transmitter to the receiver; or if the synchronization is unsuccessful, the transmitter transmits the signal with an adjusted frequency and/or bit rate and the receiver attempts to synchronize on the basis of the adjusted signal.

The transmitter and receiver typically operate in accordance with the method according to the first aspect of the present invention.

Preferably, the system comprises a further transmitter at the second location for sending a signal to the transmitter at the first location to confirm synchronization.

A transmitter can be provided at the second location for transmitting the signal to a third location as an acoustic or electromagnetic signal.

The transmitter and receiver are preferably both configured to synchronize to frequencies selected from a predetermined set of frequencies.

The transmitter can also adjust to lower the bit rate of the transmitted signal in the event that the receiver fails to synchronize.

A third aspect of the present invention provides a method for demodulating a mono-carrier acoustic signal representative of particular data, wherein the modulated acoustic signal is transmitted along tubing in a borehole, the method comprising the steps of:

(i) transmitting a modulated acoustic signal on a predetermined carrier frequency and bit rate from a transmitter located at a first location on the tubing;

(ii) attempting to synchronize the modulated acoustic signal on multiple predetermined frequencies at a receiver located at a second location on the tubing; and (iiia) if the synchronization is successful for one of the transmitted frequencies, decoding the data on the synchronized frequency and transmitting an acknowledgement signal on the synchronized frequency to the transmitter; or (iiib) if the synchronization is unsuccessful for one of the transmitted frequencies, adjusting the carrier frequency and/or bit rate, and repeating steps (i)-(iii) on the basis of the adjusted modulated acoustic signal.

According to an embodiment of the third aspect, step (iiia) may further comprise transmitting the modulated acoustic signal to a receiver located at a third location on the tubing. In another preferred embodiment, step (iiib) may comprise adjusting the carrier frequency to one of a predetermined set of frequencies, and moreover the bit rate of the modulated acoustic signal may be adjusted to a lower bit rate. The adjustment of the bit rate may follow adjusting the carrier frequency.

In accordance with another embodiment of the present invention, step (i) comprises transmitting a modulated acoustic signal on multiple predetermined carrier frequencies. Step (iiia) of this embodiment may further comprise selecting the best synchronized frequency for transmitting an acknowledgement signal to the transmitter.

The predetermined carrier frequency for each embodiment may be chosen from a frequency sweep at a predetermined time where at least one frequency is chosen based on quality indicators determined at a receiver located on the tubing.

Further aspects, characteristics, and advantages of the present disclosure will be apparent from the following detailed description.

BRIEF DESCRIPTION OF THE DRAWINGS

Certain embodiments of the present invention will hereafter be described with reference to the accompanying drawings, wherein like reference numerals denote like elements, and.

DETAILED DESCRIPTION

Figure 1:
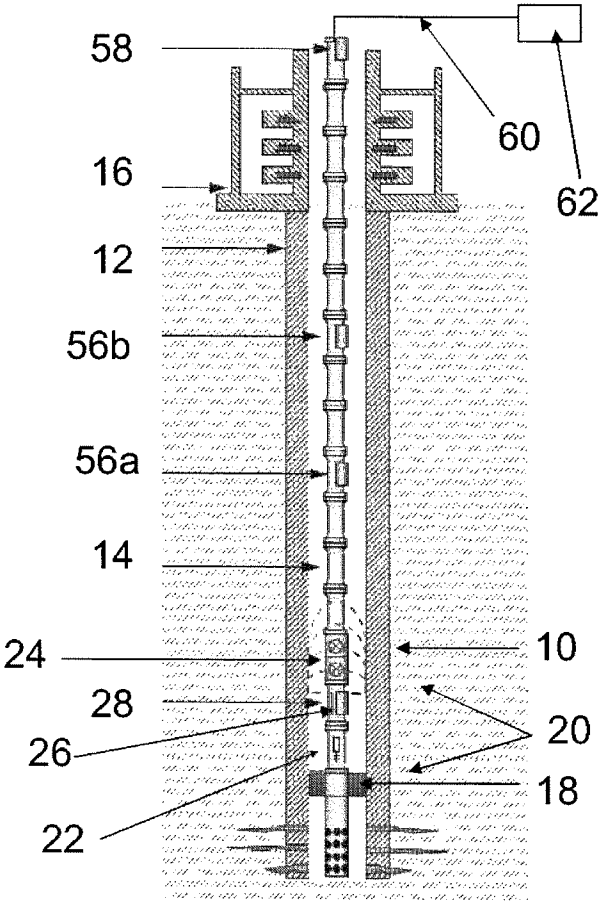
FIG. 1 shows a schematic view of an acoustic telemetry system according to an embodiment of the present invention.

The present invention is particularly applicable to testing installations such as are used in oil and gas wells or the like. FIG. 1 shows a schematic view of such a system. Once the well has been drilled through a formation, the drill string can be used to perform tests, and determine various properties of the formation though which the well has been drilled. In the example of FIG. 1, the well 10 has been lined with a steel casing 12 (cased hole) in the conventional manner, although similar systems can be used in unlined (open hole) environments. In order to test the formations, it is preferable to place testing apparatus in the well close to the regions to be tested, to be able to isolate sections or intervals of the well, and to convey fluids from the regions of interest to the surface. This is commonly done using a jointed tubular drill pipe, drill string, production tubing, or the like (collectively, tubing 14) which extends from the well-head equipment 16 at the surface (or sea bed in subsea environments) down inside the well to the zone of interest. The well-head equipment 16 can include blow-out preventers and connections for fluid, power and data communication.

A packer 18 is positioned on the tubing 14 and can be actuated to seal the borehole around the tubing 14 at the region of interest. Various pieces of downhole test equipment 20 are connected to the tubing 14 above or below the packer 18. Such downhole equipment 20 may include, but is not limited to: additional packers; tester valves; circulation valves; downhole chokes; firing heads; TCP (tubing conveyed perforator) gun drop subs; samplers; pressure gauges; downhole flow meters; downhole fluid analyzers; and the like.

In the embodiment of FIG. 1, a sampler 22 is located above the packer 18 and a tester valve 24 located above the packer 18. The downhole equipment 20 is connected to a downhole modem 26 which is mounted in a gauge carrier 28 positioned between the sampler 22 and tester valve 24. The modem 26, also referred to as an acoustic transceiver or transducer, operates to allow electrical signals from the equipment 20 to be converted into acoustic signals for transmission to the surface via the tubing 14, and to convert acoustic tool control signals from the surface into electrical signals for operating the downhole equipment 20. The term "data," as used herein, is meant to encompass control signals, tool status, and any variation thereof whether transmitted via digital or analog.

Figure 2:
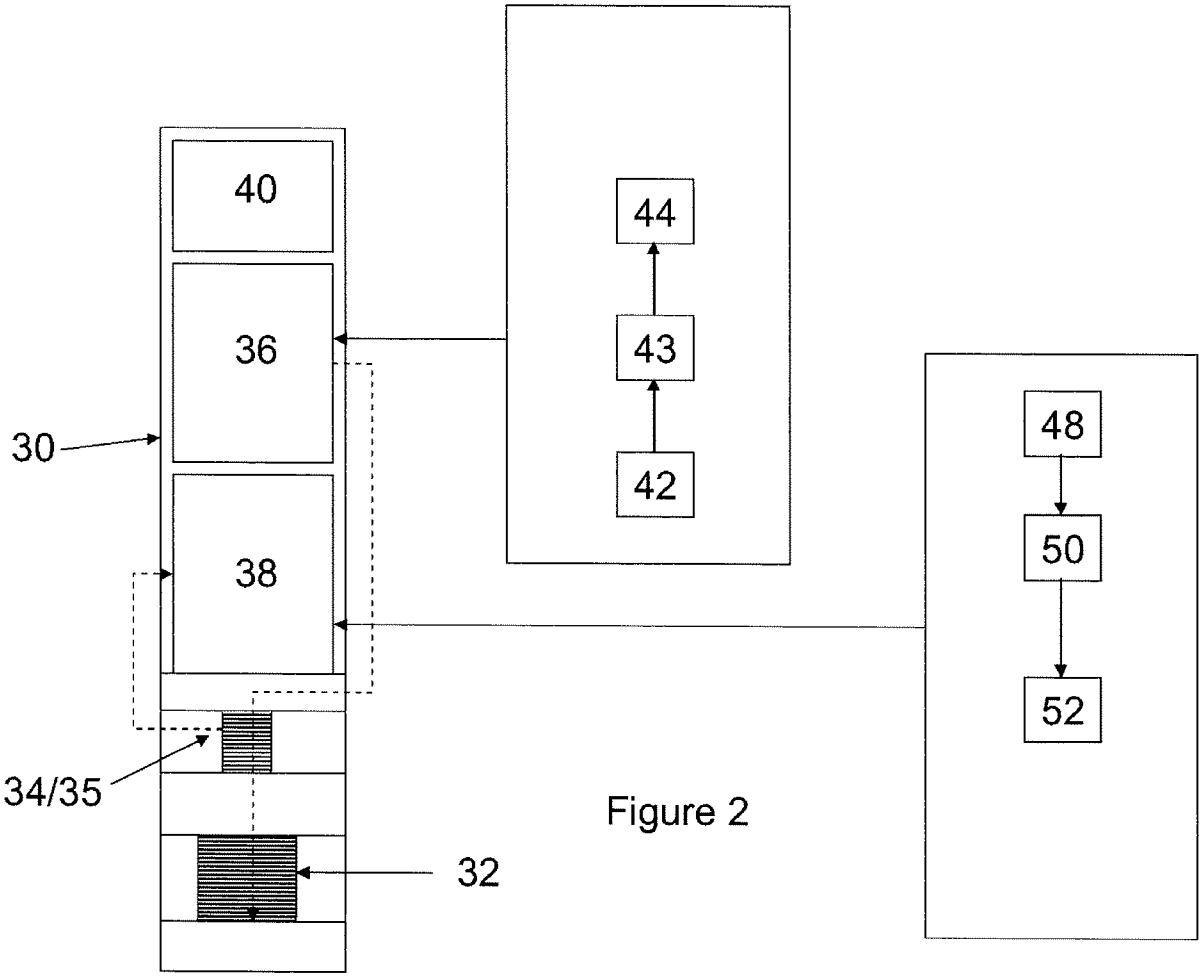
FIG. 2 shows a schematic of a modem as used in accordance with the embodiment of FIG. 1.

FIG. 2 shows a schematic of the modem 26 in more detail. The modem 26 comprises a housing 30 supporting a piezo electric actuator or stack 32 which can be driven to create an acoustic signal in the tubing 14 when the modem 26 is mounted in the gauge carrier 28. The modem 26 can also include an accelerometer 34 or monitoring piezo sensor 35 for receiving acoustic signals. Where the modem 26 is only required to act as a receiver, the piezo actuator 32 may be omitted. Transmitter electronics 36 and receiver electronics 38 are also located in the housing 30 and power is provided by means of a battery, such as a lithium rechargeable battery 40. Other types of power supply may also be used.

The transmitter electronics 36 are arranged to initially receive an electrical output signal from a sensor 42, for example from the downhole equipment 20 provided from an electrical or electro/mechanical interface. Such signals are typically digital signals which can be provided to a microcontroller 43 which modulates the signal in one of a number of known ways PSK, QPSK, QAM, and the like. The resulting modulated signal is amplified by either a linear or non-linear amplifier 44 and transmitted to the piezo stack 32 so as to generate an acoustic signal in the material of the tubing 14.

The acoustic signal that passes along the tubing 14 as a longitudinal and/or flexural wave comprises a carrier signal with an applied modulation of the data received from the sensors 42. The acoustic signal typically has, but is not limited to, a frequency in the range 1-10 kHz, preferably in the range 2-5 kHz, and is configured to pass data at a rate of, but is not limited to, about 1 bps to about 200 bps, preferably from about 5 to about 100 bps, and more preferably about 50 bps. The data rate is dependent upon conditions such as the noise level, carrier frequency, and the distance between the repeaters. A preferred embodiment of the present invention is directed to a combination of a short hop acoustic telemetry system for transmitting data between a hub located above the main packer 18 and a plurality of downhole tools and valves below and/or above said packer 18. Then the data and/or control signals can be transmitted from the hub to a surface module either via a plurality of repeaters as acoustic signals or by converting into electromagnetic signals and transmitting straight to the top. The combination of a short hop acoustic with a plurality of repeaters and/or the use of the electromagnetic waves allows an improved data rate over existing systems. The system may be designed to transmit data as high as 200 bps. Other advantages of the present system exist.

The receiver electronics 38 are arranged to receive the acoustic signal passing along the tubing 14 produced by the transmitter electronics of another modem. The receiver electronics 38 are capable of converting the acoustic signal into an electric signal. In a preferred embodiment, the acoustic signal passing along the tubing 14 excites the piezo stack 32 so as to generate an electric output signal (voltage); however, it is contemplated that the acoustic signal may excite an accelerometer 34 or an additional piezo stack 35 so as to generate an electric output signal (voltage). This signal is essentially an analog signal carrying digital information. The analog signal is applied to a signal conditioner 48, which operates to filter/condition the analog signal to be digitalized by an A/D (analog-to-digital) converter 50. The A/D converter 50 provides a digitalized signal which can be applied to a microcontroller 52. The microcontroller 52 is preferably adapted to demodulate the digital signal in order to recover the data provided by the sensor 42 connected to another modem, or provided by the surface. The type of signal processing depends on the applied modulation (i.e. PSK, QPSK, QAM, and the like).

The modem 26 can therefore operate to transmit acoustic data signals from the sensors in the downhole equipment 20 along the tubing 14. In this case, the electrical signals from the equipment 20 are applied to the transmitter electronics 36 (described above) which operate to generate the acoustic signal. The modem 26 can also operate to receive acoustic control signals to be applied to the downhole equipment 20. In this case, the acoustic signals are demodulated by the receiver electronics 38 (described above), which operate to generate the electric control signal that can be applied to the equipment 20.

In order to support acoustic signal transmission along the tubing 14 between the downhole location and the surface, a series of repeater modems 56*a*, 56*b*, etc. may be positioned along the tubing 14. These repeater modems 56*a* and 56*b* can operate to receive an acoustic signal generated in the tubing 14 by a preceding modem and to amplify and retransmit the signal for further propagation along the drill string. The number and spacing of the repeater modems 56*a* and 56*b* will depend on the particular installation selected, for example on the distance that the signal must travel. A typical spacing between the modems is around 1,000 ft, but may be much more or much less in order to accommodate all possible testing tool configurations. When acting as a repeater, the acoustic signal is received and processed by the receiver electronics 38 and the output signal is provided to the microcontroller 52 of the transmitter electronics 36 and used to drive the piezo stack 32 in the manner described above. Thus an acoustic signal can be passed between the surface and the downhole location in a series of short hops.

The role of a repeater is to detect an incoming signal, to decode it, to interpret it and to subsequently rebroadcast it if required. In some implementations, the repeater does not decode the signal but merely amplifies the signal (and the noise). In this case the repeater is acting as a simple signal booster. However, this is not the preferred implementation selected for wireless telemetry systems of the present invention.

Repeaters are positioned along the tubing/piping string. A repeater will either listen continuously for any incoming signal or may listen from time to time.

The acoustic wireless signals, conveying commands or messages, propagate in the transmission medium (the tubing) in an omni-directional fashion, that is to say up and down. It is not necessary for the modem to know whether the acoustic signal is coming from another repeater above or below. The direction of the message is preferably embedded in the message itself. Each message contains several network addresses: the address of the transmitter (last and/or first transmitter) and the address of the destination modem at least. Based on the addresses embedded in the messages, the repeater will interpret the message and construct a new message with updated information regarding the transmitter and destination addresses. Messages will be transmitted from repeaters to repeaters and slightly modified to include new network addresses.

Referring again to FIG. 1, a surface modem 58 is provided at the well head 16 which provides a connection between the tubing 14 and a data cable or wireless connection 60 to a control system 62 that can receive data from the downhole equipment 20 and provide control signals for its operation.

Figure 3:
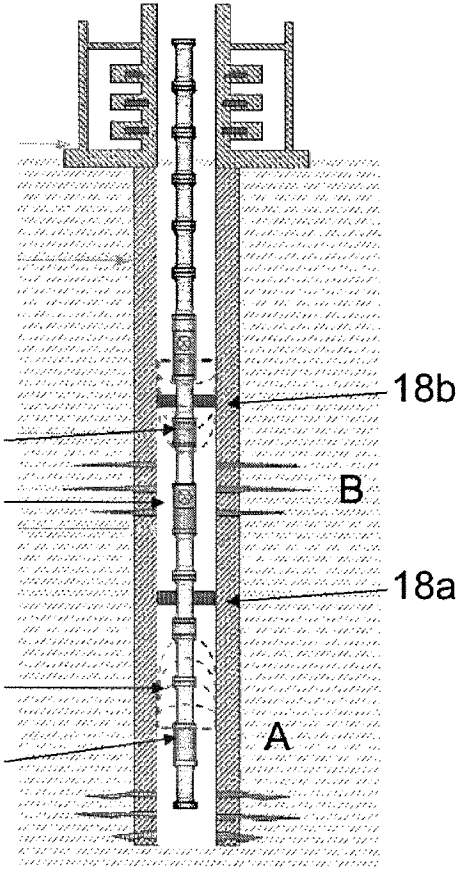
FIG. 3 shows a variant of the embodiment of FIG. 1.

In the embodiment of FIG. 1, the acoustic telemetry system is used to provide communication between the surface and the downhole location. FIG. 3 shows another embodiment in which acoustic telemetry is used for communication between tools in multi-zone testing. In this case, two zones A, B of the well are isolated by means of packers 18*a*, 18*b*. Test equipment 20*a*, 20*b* is located in each isolated zone A, B, corresponding modems 26*a*, 26*b* being provided in each case. Operation of the modems 26*a*, 26*b* allows the equipment 20*a*, 20*b* in each zone to communicate with each other as well as allowing communication from the surface with control and data signals in the manner described above.

Figure 4:
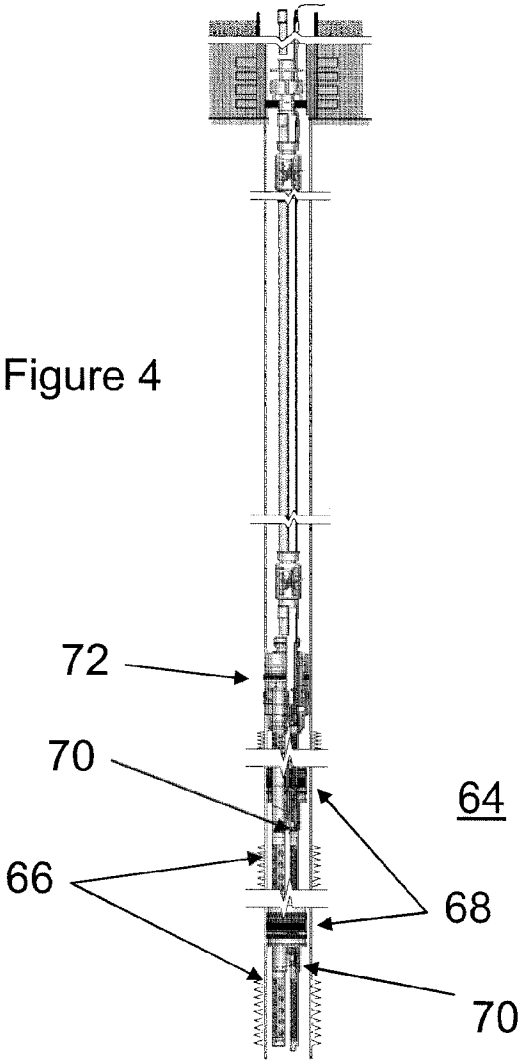
FIG. 4 shows a hybrid telemetry system according to an embodiment of the present invention.
Figure 5:
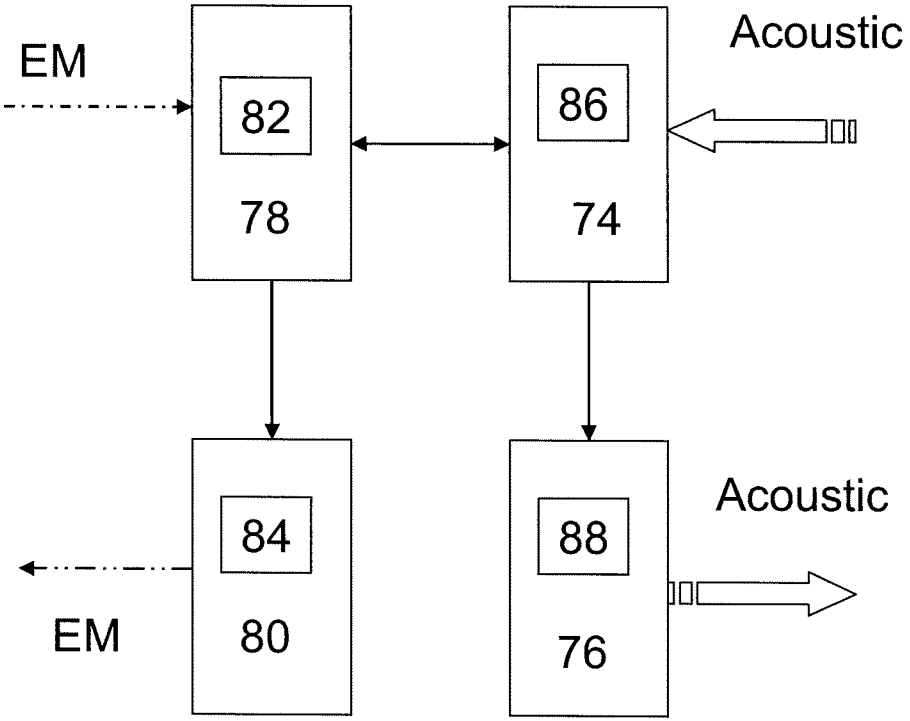
FIG. 5 shows a schematic view of a modem.

FIG. 4 shows an embodiment of the present invention with a hybrid telemetry system. The testing installation shown in FIG. 4 comprises a lower section 64 which corresponds to that described above in relation to FIGS. 1 and 3. As before, downhole equipment 66 and packer(s) 68 are provided with acoustic modems 70. However, in this case, the uppermost modem 72 differs in that signals are converted between acoustic and electromagnetic formats. FIG. 5 shows a schematic of the modem 72. Acoustic transmitter and receiver electronics 74, 76 correspond essentially to those described above in relation to FIG. 2, receiving and emitting acoustic signals via piezo stacks 32 (or accelerometers). Electromagnetic (EM) receiver and transmitter electronics 78, 80 are also shown, each of which having an associated microcontroller 82, 84; however, it should be appreciated, that the EM receiver and transmitter electronics 78, 80 may also share a single microcontroller. A typical EM signal will be a digital signal typically in the range of 0.25 Hz to about 8 Hz, and more preferably around 1 Hz. This signal is received by the receiver electronics 78 and passed to an associated microcontroller 82. Data from the microcontroller 82 can be passed to the acoustic receiver microcontroller 86 and on to the acoustic transmitter microcontroller 88 where it is used to drive the acoustic transmitter signal in the manner described above. Likewise, the acoustic signal received at the receiver microcontroller 86 can also be passed to the EM receiver microcontroller 82 and then on to the EM transmitter microcontroller 84 where it is used to drive an EM transmitter antenna to create the digital EM signal that can be transmitted along the well to the surface. In an alternative embodiment (not shown), the acoustic transmitter and receiver electronics 74, 76 may share a single microcontroller adapted for modulating and demodulating the digital signal. A corresponding EM transceiver (not shown) can be provided at the surface for connection to a control system.

Figure 6:
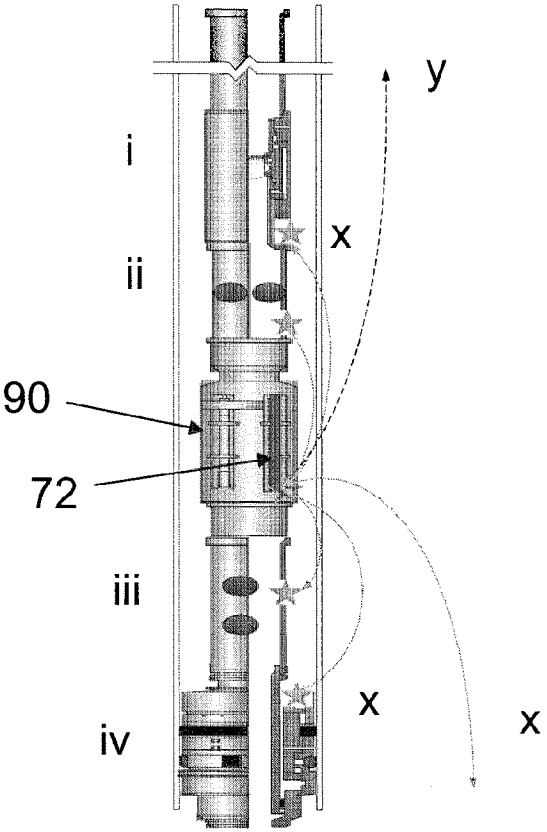
FIG. 6 shows a detailed view of a downhole installation incorporating the modem of FIG. 5.

FIG. 6 shows a more detailed view of a downhole installation in which the modem 72 forms part of a downhole hub 90 that can be used to provide short hop acoustic telemetry X with the various downhole tools 20 (e.g. test and circulation valves (i), flowmeter (ii), fluid analyzer (iii) and packer (iv), and other tools below the packer (iv)), and long hop EM telemetry Y to the surface. It should be understood that while not show, the EM telemetry signal may be transmitted further downhole to another downhole hub or downhole tools.

Figure 7:
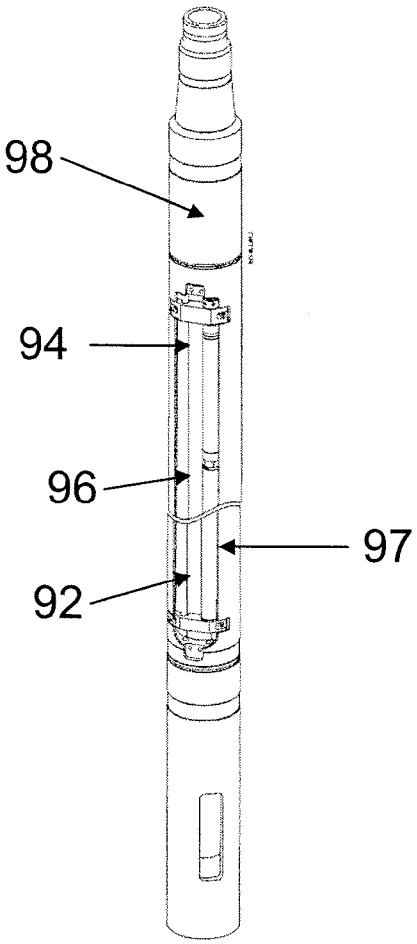
FIG. 7 shows one embodiment of mounting the modem according to an embodiment of the present invention.

FIG. 7 shows the manner in which a modem 92 can be mounted in downhole equipment. In the case shown, the modem 92 is located in a common housing 94 with a pressure gauge 96, although other housings and equipment can be used. The housing 94 is positioned in a recess 97 on the outside of a section of tubing 98 provided for such equipment and is commonly referred to as a gauge carrier 97. By securely locating the housing 94 in the gauge carrier 97, the acoustic signal can be coupled to the tubing 98. Typically, each piece of downhole equipment will have its own modem for providing the short hop acoustic signals, either for transmission via the hub and long hop EM telemetry, or by long hop acoustic telemetry using repeater modems. The modem is hard wired into the sensors and actuators of the equipment so as to be able to receive data and provide control signals. For example, where the downhole equipment comprises an operable device such as a packer, valve or choke, or a perforating gun firing head, the modem will be used to provide signals to set/unset, open/close or fire as appropriate. Sampling tools can be instructed to activate, pump out, etc.; and sensors such as pressure and flow meters can transmit recorded data to the surface. In most cases, data will be recorded in tool memory and then transmitted to the surface in batches. Likewise tool settings can be stored in the tool memory and activated using the acoustic telemetry signal.

Figure 8:
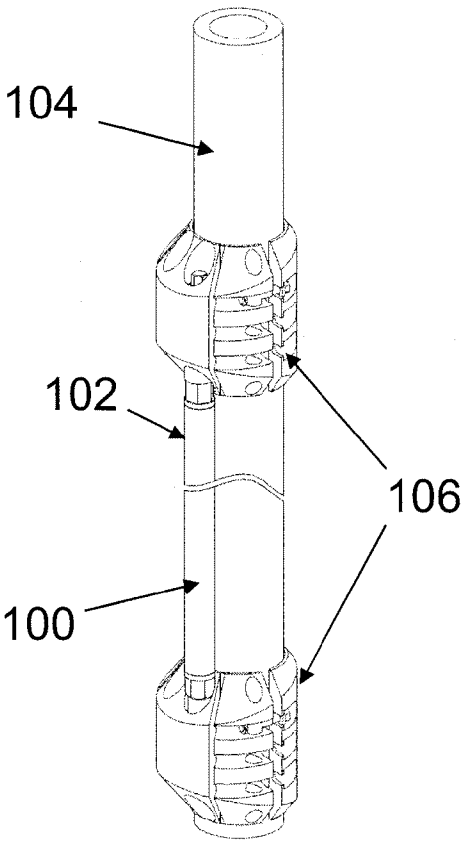
FIG. 8 shows one embodiment of mounting a repeater modem according to an embodiment of the present invention.

FIG. 8 shows one embodiment for mounting the repeater modem 100 on tubing 104. In this case, the modem 100 is provided in an elongate housing 102 which is secured to the outside of the tubing 104 by means of clamps 106. Each modem 100 may be a stand-alone installation, the tubing 104 providing both the physical support and signal path.

Figure 9:
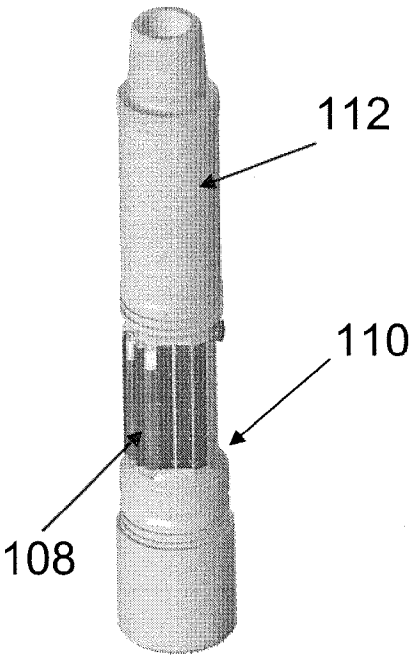
FIG. 9 shows a dedicated modem sub for mounting according to an embodiment of the present invention.

FIG. 9 shows an alternative embodiment for mounting the repeater modem 108. In this case, the modem 108 is mounted in an external recess 110 of a dedicated tubular sub 112 that can be installed in the drill string between adjacent sections of drill pipe, or tubing. Multiple modems can be mounted on the sub for redundancy.

The preferred embodiment of the present invention comprises a two-way wireless communication system between downhole and surface, combining different modes of electromagnetic and acoustic wave propagations. It may also include a wired communication locally, for example in the case of offshore operations. The system takes advantage of the different technologies and combines them into a hybrid system, as presented in FIG. 4.

The purpose of combining the different types of telemetry is to take advantage of the best features of the different types of telemetry without having the limitations of any single telemetry means. The preferred applications for embodiments of the present invention are for single zone and multi-zone well testing in land and offshore environments. In the case of the deep and ultra-deep offshore environments, the communication link has to be established between the floating platform (not shown) and the downhole equipment 66 above and below the packer 68. The distance between the rig floor (on the platform) and the downhole tools can be considerable, with up to 3 km of sea water and 6 km of formation/well depth. There is a need to jump via a 'Long Hop' from the rig floor to the top of the downhole equipment 66 but afterwards it is necessary to communicate locally between the tools 66 (sensors and actuators) via a 'Short Hop' within a zone or across several zones. The Short Hop is used as a communication means that supports distributed communication between the Long Hop system and the individual tools that constitute the downhole equipment 66, as well as between some of these tools within the downhole installation. The Short Hop communication supports: measurement data; gauge pressure and temperature; downhole flowrates; fluid properties; and downhole tool status and activation commands, such as but not limited to: IRDV; samplers (multiple); firing heads (multiple); packer activation; other downhole tools (i.e., tubing tester, circulating valve, reversing valve); and the like.

Figure 10:
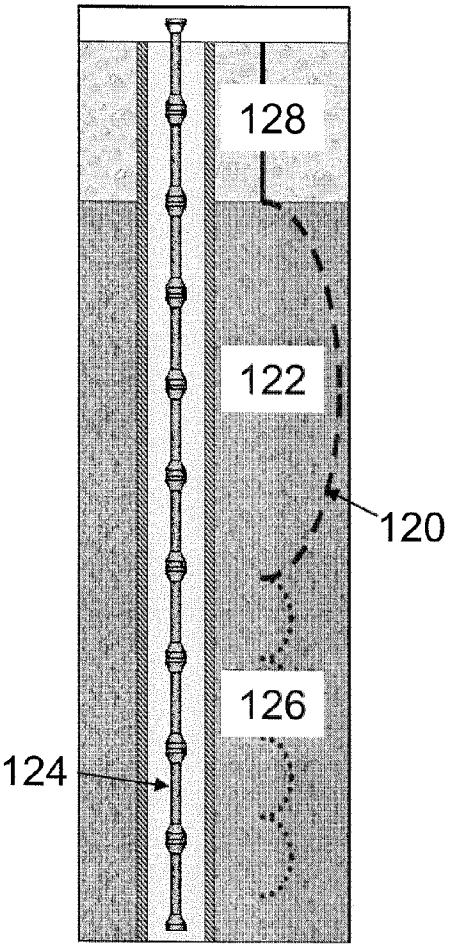
Figure 13:
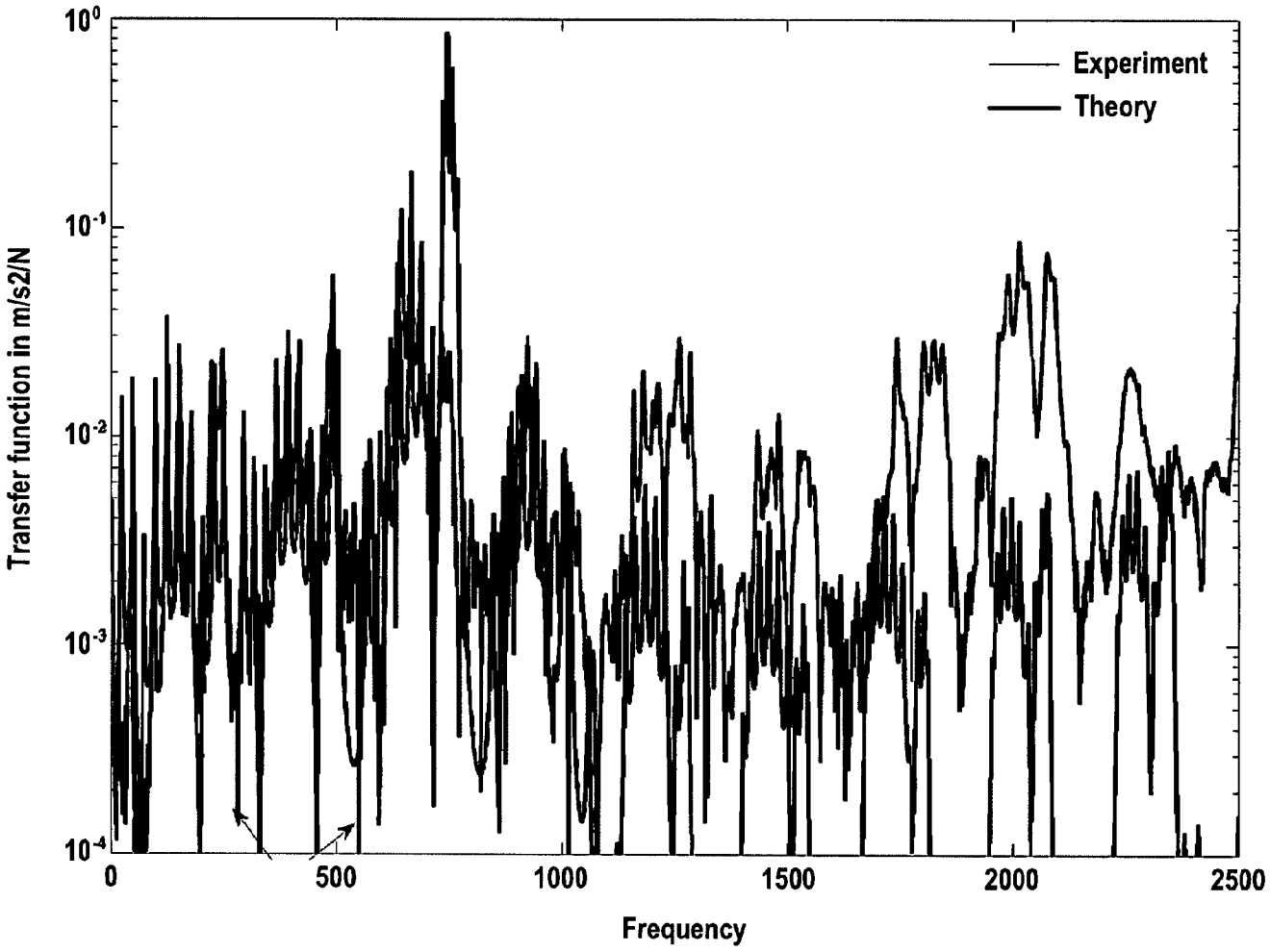
FIG. 13 depicts an acoustic frequency response of a pipe structure.

All telemetry channels, being wireless or not, have limitations from a bandwidth, deployment, cost or reliability point of view. These are summarized in FIG. 10.

At low frequency (~1 Hz), electromagnetic waves 120 propagate very far with little attenuation through the formation 122. The higher the formation resistivity, the longer the wireless communication range. The main advantages of electromagnetic wave communication relate to the long communication range, the independence of the flow conditions and the tubing string configuration 124.

Acoustic wave propagation 126 along the tubing string 124 can be made in such a way that each element of the system is small and power effective by using high frequency sonic wave (1 to 10 kHz). In this case, the main advantages of this type of acoustic wave communication relate to the small footprint and the medium data rate of the wireless communication.

Electrical or optical cable technology 128 can provide the largest bandwidth and the most predictable communication channel. The energy requirements for digital communication are also limited with electrical or optical cable, compared to wireless telemetry systems. It is however costly and difficult to deploy cable over several kilometers in a well (rig time, clamps, subsea tree) especially in the case of a temporary well installation, such as a well test.

In the case of deep-offshore single zone or multi-zone well testing, an appropriate topology for the hybrid communication system is to use a cable 128 (optical or electrical) from the rig floor to the seabed, an electromagnetic wireless communication 120 from the seabed to the top of the downhole equipment and an acoustic communication 126 for the local bus communication.

Another way to combine the telemetry technologies is to place the telemetry channels in parallel to improve the system reliability through redundancy.

Figure 12:
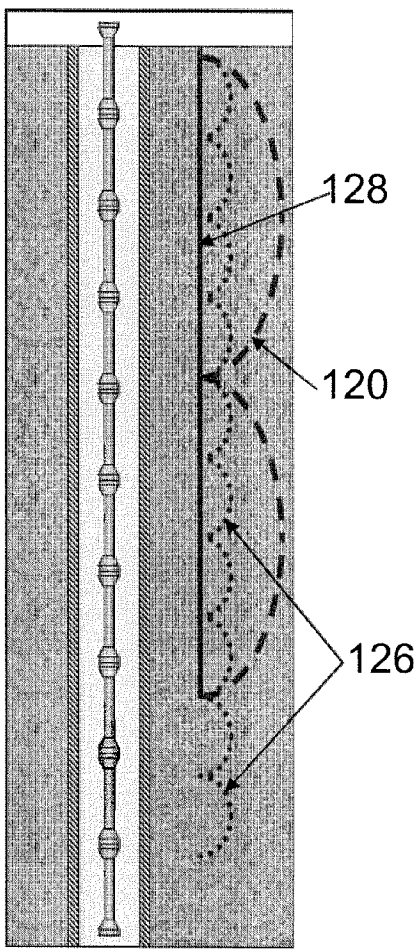
FIGS. 10, 11 and 12 illustrate applications of a hybrid telemetry system according to an embodiment of the present invention.
Figure 11:
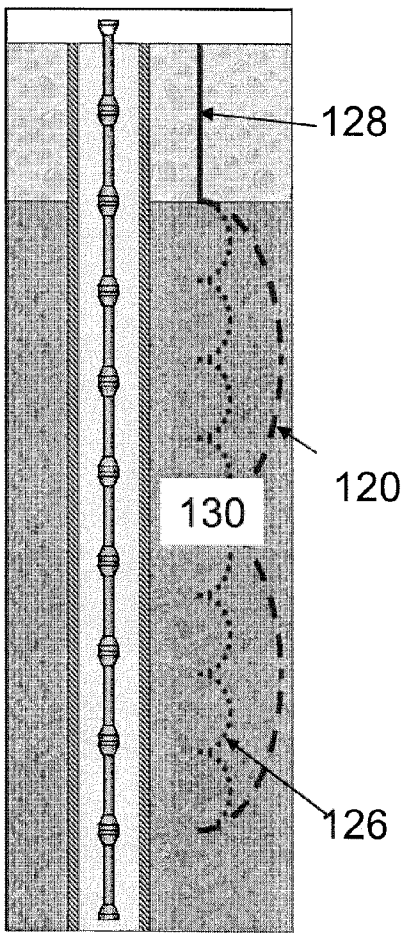

FIGS. 11 and 12 represent two cases where two or three communication channels are placed in parallel. In FIG. 11, both electromagnetic 120 and acoustic 126 wireless communication is used to transmit data to the wellhead; and a cable 128 leads from the wellhead to the rig floor (not shown). In such configurations, common nodes 130 to the different communication channels can be used. Such nodes 130 have essentially the similar functions to the hub described above in relation to FIG. 6. In FIG. 12, electromagnetic 120 and acoustic 126 wireless, and cable 128 are all provided down to the downhole location, the acoustic wireless signal being used between the downhole tools. The selection of the particular communication channel used can be done at surface or downhole or at any common node between the channels. Multiple paths exist for commands to go from surface to downhole and for data and status to go from downhole to surface. In the event of communication loss on one segment of one channel, an alternate path can be used between two common nodes.

Figure 14:
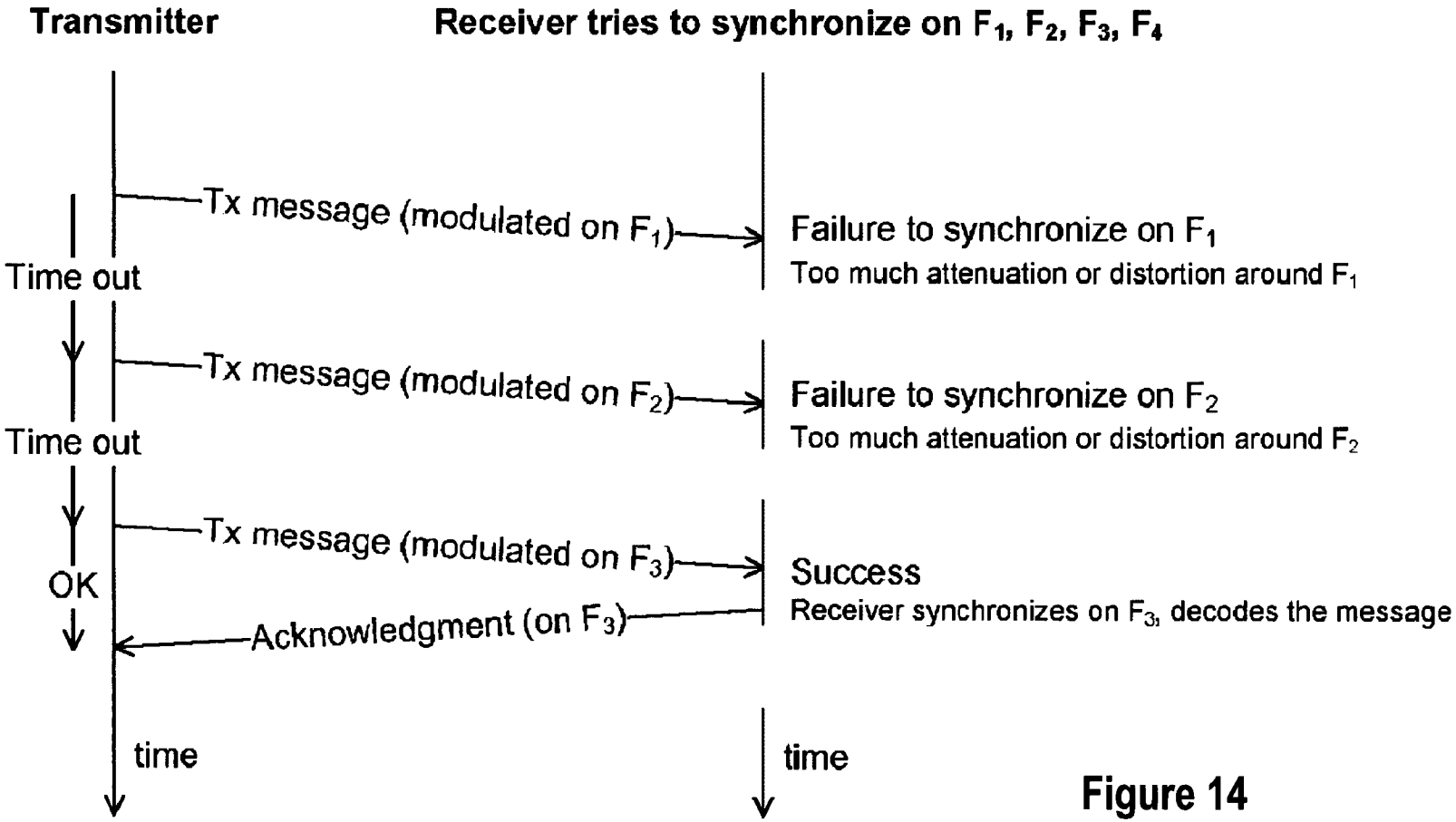
FIG. 14 illustrates a flow diagram of a method according to an embodiment of the present invention.
Figure 15:
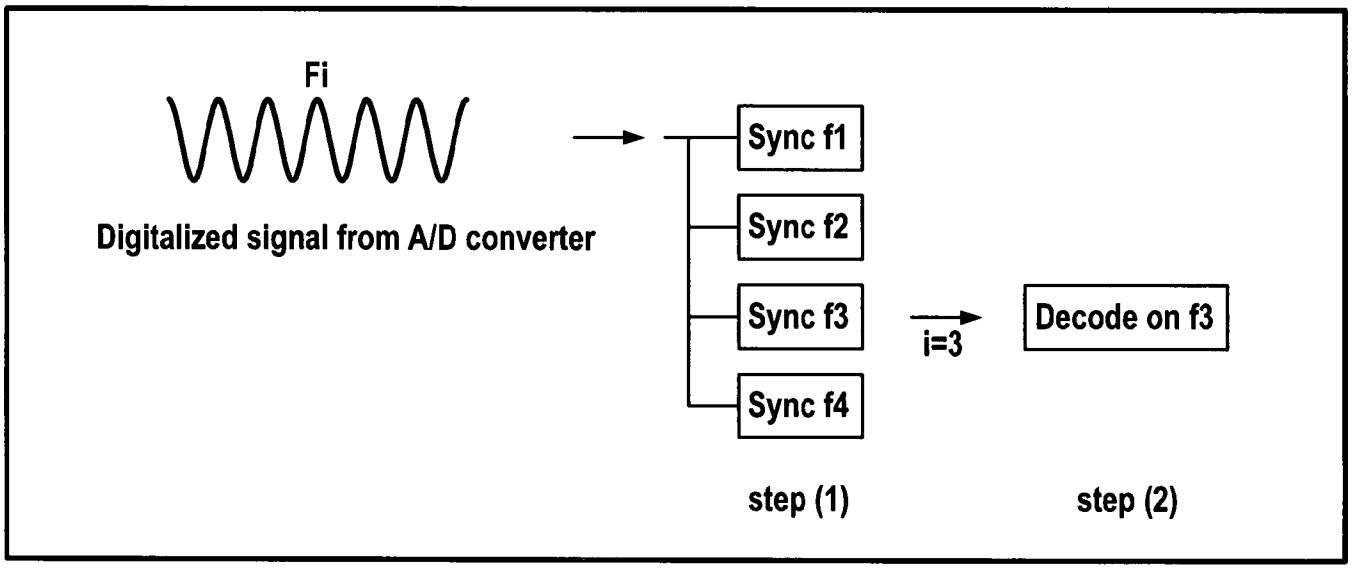
FIG. 15 shows a flow diagram of a receiver architecture for use in an embodiment of the present invention.

A preferred embodiment of the present invention is based on a protocol in which a transmitter transmits a message (i.e., a control signal or data signal) on sequential frequencies belonging to a predetermined set $S_f$ of N frequencies until the communication succeeds. The embodiment preferably uses a receiver for parallel synchronization which simultaneously tries to demodulate the incoming signals transmitted by another tool/modem on the predetermined frequencies $S_f$. The protocol is illustrated in FIG. 14, in which $S_f$ is shown to comprise four frequencies $F_1$-$F_4$, however, the predetermined set of frequencies may include much more or much less. A scheme of the parallel receiver is shown in FIG. 15.

In the example illustrated in FIG. 14, the transmitter initially transmits a signal at frequency $F_1$. The receiver attempts to synchronize at multiple frequencies, $F_1$-$F_4$, but due to attenuation or distortion of the signal at this frequency, is unable to synchronize with this signal on $F_1$ as so does not send any acknowledgement signal back to the transmitter. When starting to transmit at a given frequency, the transmitter starts a timing routine. If no acknowledgement is received from the receiver within a predetermined time interval, the transmitter times out and switches to the next frequency $F_2$. This process is repeated until an acknowledgement signal is received from the receiver on the same frequency, at which time the transmitter begins data transmission. One advantage of the parallel synchronization illustrated in the example of FIG. 14 is the robustness of the process, and the removal of the need for frequency detection. In the example of FIG. 14, synchronization occurs at frequency $F_3$. It is contemplated that while one carrier frequency may be chosen for transmission from modem A to modem B, a different second carrier frequency may be chosen for transmission from modem B to modem A.

The selection of an initial transmission frequency is preferably chosen from a set of frequencies based on past experience, but may also include an automatic mechanism at the beginning of the communication. This mechanism could consists in having all the transmitters transmitting frequency sweeps at a predetermined time and all the receivers in the tubing string recording the incoming frequency sweeps, then determining the N best frequencies based on quality indicators such as amplitude, signal-to-noise ratio and spectrum flatness.

Based on the spectral estimate of the communication channel in various cases and assuming the set $S_f$ is well chosen, it is very likely that there is at least one carrier frequency out of N (N being small, such as 4 or 5, but may be much more) with limited attenuation and distortion.

FIG. 15 shows schematically the receiver architecture used for parallel synchronization. This corresponds to the signal processing preferably implemented in the micro-controller of the receiver electronics, depicted in FIG. 2. After the analog signal is digitalized by the A/D converter, the resulting digitalized signal is simultaneously demodulated by the micro-controller on the predetermined set of frequencies belonging to Sf. The demodulation process preferably comprises two steps.

In the first step, the micro-controller simultaneously attempts to synchronize on the frequencies Sf. Where the incoming signal only has one frequency, the micro-controller attempts to synchronize on multiple frequencies, but may only succeed to synchronize on this signal frequency (the "synchronized frequency"). A synchronization process is based on correlation; where parallel synchronization consists of multiple, simultaneous correlations. If the synchronization is successful on the synchronized frequency, the beginning of the received signal is well known as well as its frequency. However, certain parameters, such as the phase and carrier frequency offset, can be estimated. In a second step, the modulated signal is decoded and the data recovered. Where the incoming signal is transmitted on multiple frequencies, the micro-controller selects the best frequency based on the highest correlation ratio and proceeds to decode the data on the best frequency.

In the example of FIG. 14, the messages are all transmitted at the same bit rate and the receiver tries to synchronize on different frequencies at a single given bit rate. In another embodiment of the present invention, the bit rate can be varied. If the signal channel is unusually very noisy and none of the transmitted signals is recovered by the receiver, the system of FIG. 14 will not work. In order to avoid this, the receiver can also synchronize at a lower bit rate for each of the frequencies belonging to $S_f$.

The transmitter will first try to transmit its messages at high bit rate. In case of failure, it will transmit them at successively lower bit rates. Since the energy per bit becomes higher as the bit rate decreases, the bit energy-to-noise ratio ($Eb/N_0$) is increased. In addition, since the signal bandwidth is reduced, the received acoustic signal is less distorted by the channel. Though this adds more complexity to the receiver and decreases the data rate, the communication becomes more robust.

A particularly preferred embodiment of the present invention relates to multi-zone testing (see FIG. 4). In this case, the well is isolated into separate zones by packers 68, and one or more testing tools are located in each zone. A modem is located in each zone and operates to send data to the hub 72 located above the uppermost packer. In this case, the tools in each zone operate either independently or in synchronization. The signals from each zone are then transmitted to the hub for forwarding to the surface via any of the mechanisms discussed above. Likewise, control signals from the surface can be sent down via these mechanisms and forwarded to the tools in each zone so as to operate them either independently or in concert. Signals may be transmitted to different zones utilizing multiple, redundant telemetry paths (i.e. acoustic or EM) based on a predetermined set of quality indicators related to the communication. Based on the quality indicators, the best communication path can be selected.

Although only a few embodiments of the present invention have been described in detail above, those of ordinary skill in the art will readily appreciate that many modifications are possible without materially departing from the teachings of the present invention. Accordingly, such modifications are intended to be included within the scope of the present invention as defined in the claims.

What is claimed is:

1. A method of transmitting data along tubing in a borehole, comprising generating a modulated acoustic signal using a transmitter at a first location on the tubing, and receiving the acoustic signal at a receiver at a second location on the tubing; the method further comprising:

(i) generating the acoustic signal at the transmitter at a first frequency and bit rate;

(ii) receiving the acoustic signal at the first frequency at the receiver and attempting to synchronize the receiver at the first frequency; and (iiia) if the synchronization is successful, continuing to transmit the acoustic signal so as to pass the data from the transmitter to the receiver; or (iiib) if the synchronization is unsuccessful, adjusting the frequency and bit rate of the acoustic signal and repeating steps (i)-(iii) on the basis of the adjusted signal, wherein the bit rate of the acoustic signal is adjusted to a lower bit rate.

2. The method of claim 1, wherein step (iiib) comprises adjusting the frequency to one of a predetermined set of frequencies.

3. The method of claim 2, wherein the predetermined set of frequencies comprises the first frequency and more than two further frequencies, the method further comprising iterating steps (i)-(iii) though the set of frequencies until synchronization is successful.

4. The method of claim 1, wherein the step of adjusting the bit rate follows adjustment of frequency.

5. The method as claimed in claim 1, further comprising retransmitting the data received by the receiver from the second location to a third location.

6. The method of claim 5, comprising retransmitting the data from the second location to the third location as an acoustic signal.

7. The method of claim 5, comprising retransmitting the data from the second location to the third location as an electromagnetic signal.

8. A system for transmitting data along tubing in a borehole, comprising:

a transmitter at a first location on the tubing for generating an acoustic signal in the tubing;

and a receiver at a second location on the tubing for receiving the acoustic signal;

wherein the transmitter is configured to transmit data at a first frequency and bit rate; and the receiver is configured to attempt to synchronize at the first frequency, such that if the synchronization is successful, the transmitter continues to transmit the acoustic signal so as to pass the data from the transmitter to the receiver; or if the synchronization is unsuccessful, the transmitter transmits the acoustic signal with an adjusted frequency and/or bit rate and the receiver attempts to synchronize on the basis of the adjusted frequency and/or bit rate, wherein the transmitter adjusts to lower the bit rate of the transmitted signal in the event that the receiver fails to synchronize.

9. The system as claimed in claim 8, wherein the transmitter and receiver operate in accordance with the method of claim 1.

10. The system as claimed in claim 8, further comprising a second transmitter at the second location for sending a signal to the transmitter at the first location to confirm synchronization.

11. The system as claimed in claim 8, further comprising a second transmitter at the second location for transmitting a signal to a third location.

12. The system as claimed in claim 11, wherein the transmitter at the second location transmits the signal as an acoustic or electromagnetic signal.

13. The system as claimed in claim 8, wherein the transmitter and receiver are both configured to synchronize to frequencies selected from a predetermined set of frequencies.

14. A method for demodulating a mono-carrier modulated acoustic signal representative of particular data, wherein the modulated acoustic signal is transmitted along tubing in a borehole, the method comprising the steps of:

(i) transmitting a modulated acoustic signal on a predetermined carrier frequency and bit rate from a transmitter located at a first location on the tubing;

(ii) attempting to synchronize the modulated acoustic signal on multiple predetermined frequencies at a receiver located at a second location on the tubing; and (iiia) if the synchronization is successful for one of the transmitted frequencies, decoding the data on the synchronized frequency and transmitting an acknowledgement signal on the synchronized frequency to the transmitter; or (iiib) if the synchronization is unsuccessful for one of the transmitted frequencies, adjusting the carrier frequency and bit rate, and repeating steps (i)-(iii) on the basis of the adjusted modulated acoustic signal, wherein the bit rate of the modulated acoustic signal is adjusted to a lower bit rate.

15. The method of claim 14, wherein step (iiia) further comprises transmitting the modulated acoustic signal to a receiver located at a third location on the tubing.

16. The method of claim 14, wherein step (iiib) comprises adjusting the carrier frequency to one of a predetermined set of frequencies.

17. The method of claim 14, wherein the step of adjusting the bit rate follows adjusting the carrier frequency.

18. A method for demodulating a mono-carrier modulated acoustic signal representative of particular data, wherein the modulated acoustic signal is transmitted along tubing in a borehole, the method comprising the steps of:

(i) transmitting a modulated acoustic signal on multiple predetermined carrier frequencies and at a bit rate from a transmitter located at a first location on the tubing;

(ii) attempting to synchronize the modulated acoustic signal on multiple predetermined frequencies at a receiver located at a second location on the tubing; and (iiia) if the synchronization is successful for one of the transmitted frequencies, decoding the data on the synchronized frequency and transmitting an acknowledgement signal on the synchronized frequency to the transmitter; or (iiib) if the synchronization is unsuccessful for one of the transmitted frequencies, adjusting the carrier frequency and/or bit rate, and repeating steps (i)-(iii) on the basis of the adjusted modulated acoustic signal.

19. The method of claim 18, wherein step (iiia) further comprises selecting the best synchronized frequency for transmitting an acknowledgement signal to the transmitter.

20. The method of claim 14, wherein the predetermined carrier frequency is chosen from a frequency sweep at a predetermined time and at least one frequency is chosen based on quality indicators determined at a receiver located on the tubing.

* * * * *